United States Patent [19]

Righi

[11] Patent Number: 4,837,930

[45] Date of Patent: Jun. 13, 1989

[54] SAFETY RAZOR

[75] Inventor: Nardino Righi, Milan, Italy

[73] Assignee: Eurafrica S.r.l., Milan, Italy

[21] Appl. No.: 147,186

[22] Filed: Jan. 22, 1988

[30] Foreign Application Priority Data

Jan. 30, 1987 [IT] Italy ..... 12411 A/87
Mar. 18, 1987 [IT] Italy ..... 12437 A/87

[51] Int. Cl.[4] ..... B26B 21/00
[52] U.S. Cl. ..... 30/47; 30/89
[58] Field of Search ..... 30/47, 50, 57, 66, 89

[56] References Cited

U.S. PATENT DOCUMENTS 1,878,269 9/1932 Deutsch ..... 30/47 X
2,454,374 11/1948 Bowlin ..... 30/47
2,575,539 11/1951 Bennett ..... 30/47
3,964,160 6/1976 Gordon ..... 30/89
4,332,321 6/1982 Wratschko ..... 30/47 X
4,377,034 3/1983 Druash et al. ..... 30/47 X

*Primary Examiner*—Frank T. Yost
*Assistant Examiner*—Michael D. Folkerts
*Attorney, Agent, or Firm*—Larson and Taylor

[57] ABSTRACT

The object of the invention is a safety razor, in which the one-blade or two-blade shaving head (16) is mounted at the end of the fore part (14) of a handle (1) so as to be rotatable by at least 90° around an axis which is transversal to the shaving head (16) and to the handle (1). Thus, the shaving head (16) can be caused to take at will a rest position extending in the longitudinal direction of handle (1), sidewise of the fore or upper part (14) of said handle, and a shaving position extending across the longitudinal direction of handle (1). The handle (1) is preferably made in form of a container for a shaving cream or lather, and at its rear or bottom end it is provided with a respective dispensing valve (2).

10 Claims, 7 Drawing Sheets

SAFETY RAZOR

SUMMARY OF THE INVENTION

The object of the invention is a safety razor, and its aim is to make such a razor which—in combination with a simple and economical, but thoroughly efficient construction, has very reduced overall dimensions and is close-packed in rest condition, that is, when it is not used, so that the same can be put away without occupying much space, and may be even carried with non inconvenience in a pocket.

This problem is solved by the invention with the provision of a safety razor in which its one-blade or two-blade shaving head is connected to a shaving-head carrying member which is mounted on to the end of the fore or upper part of a handle, so as to be rotatable over at least 90° around an axis which is transversal to the shaving head and to the handle, whereby it is possible to cause the shaving head to take at will either a rest position extending in the longitudinal direction of said handle.

Thus, the shaving head of the safety razor according to the invention is arranged for shaving in the usual position which is oriented transversely to the handle, and the razor can be caused to take a rest position which is substantially parallel to the handle, and in which the said razor has considerably reduced overall dimensions, so that it can be easily put away in an adequate narrow space.

Preferably, according to a further feature of the invention, the fore or upper part of the handle is of a thinner construction than the main part of the handle, at least in correspondence of the shaving head, and is eccentric relatively to the longitudinal axis of the said main part of the handle, at least over a section of such a length that in the rest position of the shaving head, in which this head is arranged substantially parallel to the longitudinal direction of the handle, sideways of the fore or upper part thereof, the overall thickness of the head and the fore or upper part of the handle is substantially equal to the thickness of the main part of the handle. Thus, in the rest position of the shaving head, the safety razor according to the invention takes a shape like a substantially straight stick with a substantially uniform thickness and, according to another feature of the invention, the said razor may be provided with a closure cap which covers the shaving head and the fore or upper part of the handle, and is fitted on the main part of the handle. Therefore, the safety razor according to the invention has in its closed condition substantially the shape and the size of a fountain pen.

The fore or upper part of the handle, about which the shaving head is fulcrumed, may be of a fixed construction, so that it is made integral with the main part of the handle.

However, according to still another feature of the invention, the fore or upper part of the handle has its base pivotally connected to the main part of the handle, so as to be pivotable around a transversal axis, whereby it is caused to alternatively assume an angular shaving position, in which it makes an angle with the longitudinal axis of the main part of the handle, and an angular rest position in which it extends in the longitudinal direction of the handle. Thus shaving is facilitated, while it is maintained the aforesaid shape of the safety razor, like a substantially straignt stick, with small overall dimensions, in the rest condition of said razor. Suitable locking means preferably or the snapping type are provided,, which lock the pivotable fore or upper part of the handle in its angular shaving position, and may be also in its rest position.

In one embodiment of the invention the main part of the razor handle is made in form of a container for a pressurized shaving cream or lather, and the same is provided at its rear or bottom end with a dispensing valve which can be covered with a cap.

In order to further improve the above disclosed type of safety razor, and particularly in order to hold in place the shaving head in a sufficiently safe manner and with the aid of means of a simple construction, which can be easily operated for moving the shaving head either into its rest position or into its shaving position, in a further embodiment of the invention a shaving head-locking bar is provided, which is slidably guided in the longitudinal direction of the handle and is apt to be pushed toward the shaving head, with which this bar cooperates through its free end, in the fashion of a lock abutment, so that it will bear with a certain pressure against a longitudinal side of the shaving head in shaving position, means being provided for withdrawing the said bar from the shaving head by a manual operation, whereby the shaving head can be freely rotated from its shaving to its rest position, and vice-versa.

In a different form of the just disclosed embodiment of the safety razor according to the invention, the shaving head-locking bar is urged toward the shaving head by a spring which is housed within a cavity in the main part of the handle, and at its rear or lower end this bar is provided with a projection slidably extending through a longitudinal slot in the main part of the handle, and which can be manually engaged for withdrawing the said bar from the shaving head. In another different embodiment of the invention, the shaving head-locking bar is engaged by means of a projection in a worm screw which is housed in the main part of the razor handle, so as to be allowed to rotate, but not to slide in the longitudinal direction, and which by means of a knob projecting from the rear or bottom end of the main part of the handle, can be manually turned so as to move the said bar toward the shaving head, and as to withdraw the same from the said head.

BRIEF DESCRIPTION OF THE DRAWINGS

Some embodiments of the safety razor according to the invention are shown in the accompanying drawings, in which.

DESCRIPTION OF THE PREFERRED EMBODIMENTS

Figures 1, 3, 4:
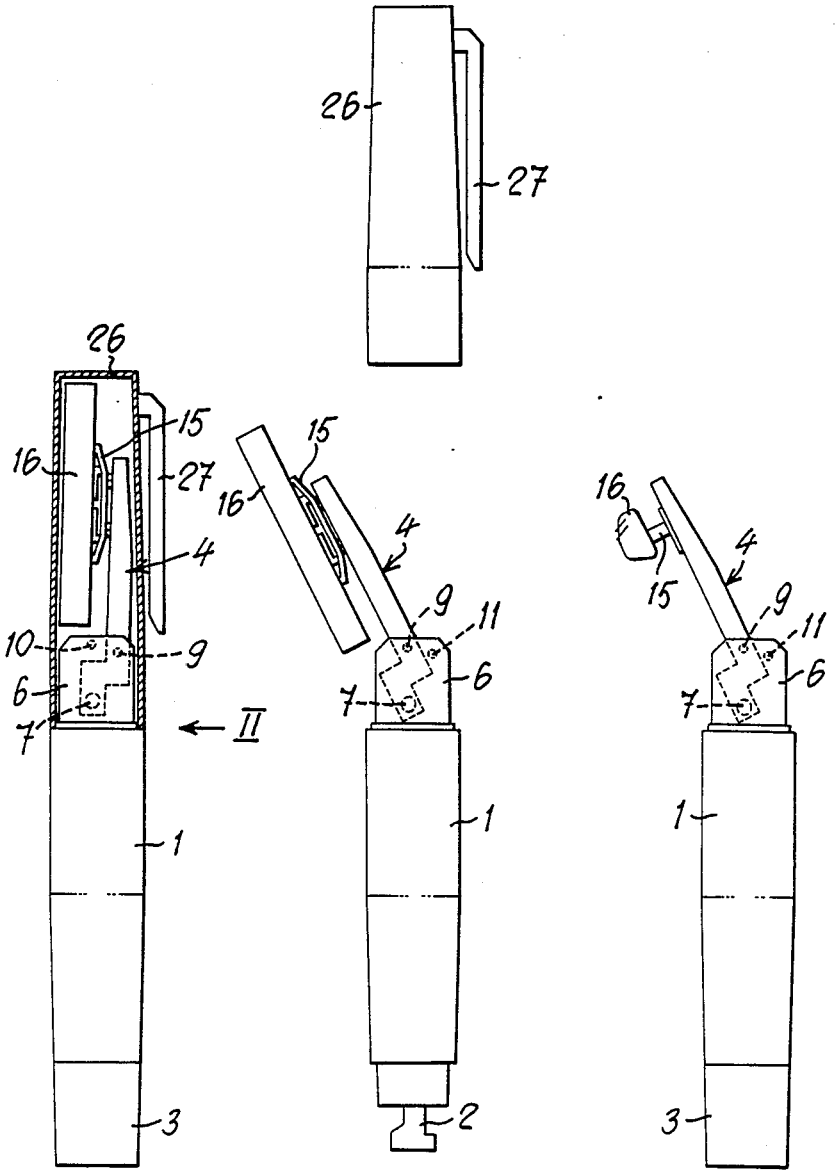
FIG. 1 shows a safety razor according to the invention, in rest position, with the closure cap being shown in a sectional view.
FIG. 3 is a partly exploded view of the razor according to FIGS. 1 and 2, showing the head-carrying member in shaving position, and the shaving head still in rest position.
FIG. 4 shows the safety razor according to FIGS. 1 to 3, in shaving conditions.

Referring to the drawings, the safety razor according to the invention consists of a handle 1 which may be made in any suitable manner. In the embodiment shown in FIGS. 1 to 8, the handle 1 is made in form of a small reservoir or bottle containing a pressurized shaving cream or shaving lather which can be dispensed by means of a convention dispensing valve 2, or the like, provided in correspondence of the rear or bottom end of handle 1, and which can be covered with a cap 3. The invention is however not limited to this embodiment, but comprises also those razors in which the handle 1 is of a solid construction, or it is hollow, but contains other products.

At its opposite end, the handle 1 carries a supporting stirrup-like member 4 which by the free end of its parallel arms is inserted between two wings 6 projecting from the fore or upper end of handle 1, and which by means of two external co-axial pivots 7 provided in its arms 5 is snappingly fitted into respective bores 8 in said wings 6. Thus, the supporting stirrup 4 is pivotable, with respect to the handle 1, around the transversal axis formed by the two pivots 7. By being pivoted around the said transversal axis 7—7, the supporting stirrup 4 can be caused to take an inclined angular position with respect to the axis of handle 1 (shaving position, shown in FIGS. 3 and 4), and an angular position extending in the longitudinal direction of the handle and which is substantially parallel to the handle axis (rest position, shown in FIG. 1). The supporting stirrup 4 is locked at least in its inclined angular shaving position, and may be also in its rest position, by two projections 9 provided on the outward side of arms 5 of the supporting stirrup 4, and which are snappingly engaged in matching recesses or bores 10, 11 provided in the wings 6 of handle 1, in correspondence of the said angular position or positions of the stirrup 4.

The pivot axis 7—7 of the supporting stirrup 4 is provided in correspondence of a median longitudinal plane of handle 1, and the supporting stirrup 4 has at a short distance over the pivot axis 7—7, such an elbow-like configuration that in its angular rest position the said supporting stirrup 4 extends in the longitudinal direction of handle 1, however in an eccentric position with respect to said handle 1.

The continuous loose end of the supporting stirrup 4 is shaped like an arc of a circle and extends between the two arms 5 of said stirrup 4. A disc 12 is housed in this arcuate end of the supporting stirrup 4 and by its peripheral edge it is rotatably engaged in a matching groove 13 in the inner face of said stirrup 4. This groove 13 in stirrup 4 extends also along the two arms 5 of said stirrup 4, throughout their length, and ends in correspondence of the elbow-shaped portion of the said two arms 5, as it appears particularly in FIG. 7. The rotatable disc 12 has a discoid co-axial extension 14 which is also encompassed by the supporting stirrup 4, but which is not engaged in the groove 13 in said stirrup. This extension 14 of disc 12 is integral with a fork 15 which extends out of the supporting stirrup 4 and carries a shaving head 16. Both the shaving head 16 and the shaving head-carrying fork 15 may be made in any suitable manner, more particularly according to any one of the known embodiments. Thus, for example, the shaving head 16 may be a one-blade or a two-blade head, and the same may be connected to the shaving head-carrying fork 15 in a rigid or in an articulated manner. In the shown embodiment, the shaving head 16 is a two-blade head and the same is fitted to the shaving head-carrying fork 15 so as to be pivotable about two opposed co-axial pivots 17 in said fork 15.

The disc 12, its extension 14, the shaving head-carrying fork 15 and may be also the shaving head 16 (when the same is rigidly connected to the shaving head-carrying fork 15) may be made as a molded single piece of plastics material.

The rotatable disc 12 is held within its housing in the loose end of the supporting stirrup 4 by a positioning platelet 18 fitted between the arms 5 of said supporting stirrup 4. In correspondence of its two opposite sides, this positioning platelet 18 has edges 19 of a smaller thickness, by means of which it is engaged in the grooves 13 provided in the inner face of the two arms 5 of the said supporting stirrup 4. In correspondence of its end turned toward the handle 1, the positioning platelet 18 has two lateral teeth 20 which are snappingly engaged in matching apertures 21 provided in the two arms 5 of the supporting stirrup 4, and which thus lock the platelet 18 in its assembled position. In the middle of its oppostie side, the positioning platelet 18 has a locking tooth 22 which cooperates with a matching locking notch 23 provided in the periphery of the extension 14 of the rotatable disc 12. The locking tooth is so made as to be elastically yieldable in the longitudinal direction of the handle 1 and the supporting stirrup 4. For this purpose, in the end of the positioning platelet 18, which is turned toward the disc 12, one or more transversal slots 24, 25 are provided, which begin from one side edge of said platelet 18, but end shortly before its opposite side edge. In the shown embodiment, two transversal spaced apart parallel slots 24, 25 are provided, which extend from opposite sides of the positioning platelet 18.

The rotatable disc 12 may be set into two angular positions, one being the shaving position, and the other the rest position. In the shaving position of the rotatable disc 12, shown in FIGS. 4 to 8, the shaving head-carrying fork 15 and then the shaving head 16, extend transversely, particularly orthogonally to the longitudinal direction of the handle 1 and the supporting stirrup 4, and are locked in this position by the locking tooth 22 in the positioning platelet 18, and the said tooth is snappingly engaged in the matching locking notch 23 in the extension 14 of the rotatable disc 12. This angular shaving position of the rotatable disc 12 is the position in which the razor is used, and in which also the whole pivotable supporting stirrup is located in the above disclosed angular shaving position, which is inclined relativelyu to the longitudinal axis of handle 1 (FIGS. 1 and 2).

Figure 2:
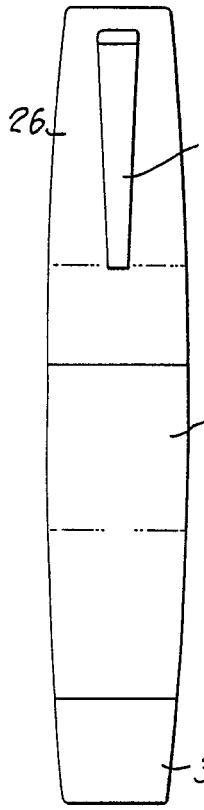
FIG. 2 is a side elevational view of said razor, according to arrow II in FIG. 1.
Figure 5:
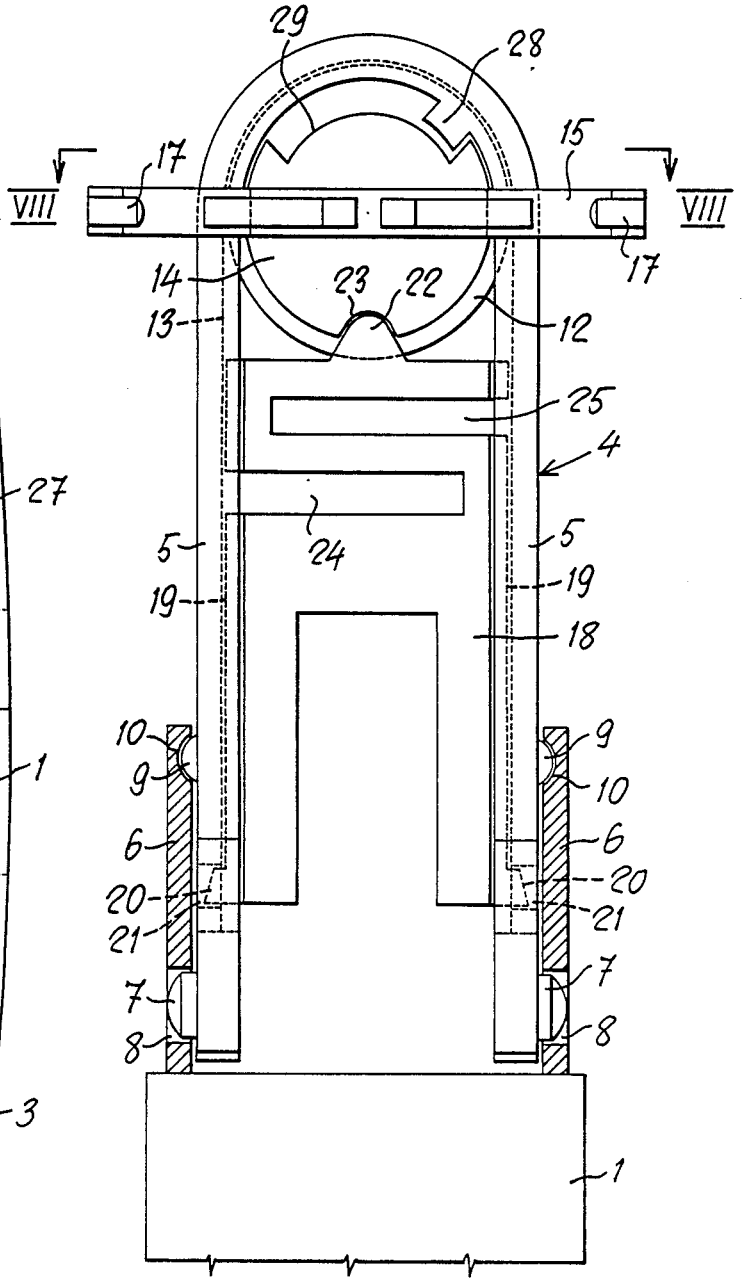
FIG. 5 is a front view in an enlarged scale showing the fore or upper part of the handle with the rotatable head-carrying member.
Figure 6:
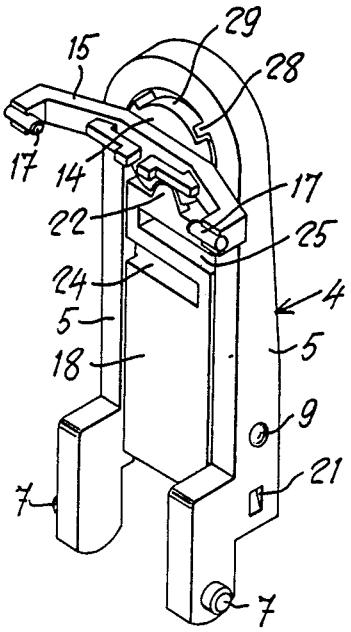
FIGS. 6 and 7 are perspective views showing the fore or upper part of the handle according to FIG. 5 in an assembled condition (FIG. 6) and in an exploded view (FIG. 7).
Figure 7:
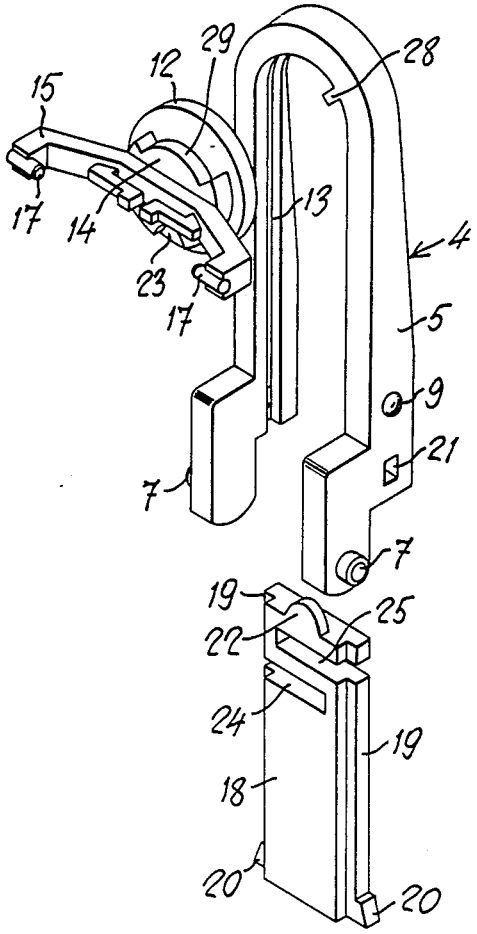
Figure 8:
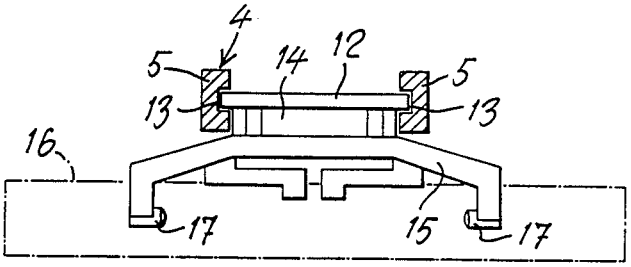
FIG. 8 is a cross-sectional view of the fore or upper part of the handle, taken on line VIII—VIII in FIG. 5.

In the angular rest position of the rotatable disc 12, the shaving head-carrying fork 15 and the shaving head 16 extend along the supporting stirrup 4 and are arranged sidewise of the pair of arms 5 and the positioning platelet 18, so that they are received in the recess obtained with the elbow configuration of said stirrup 4, as shown in FIG. 1. In this rest position, the thickness of the assembly consisting of the stirrup 4, the shaving head-carrying fork 15 and the shaving head 16, and which is measured across the longitudinal direction of the handle 1 and the supporting stirrup 4, is substantially equal to the thickness of the correlative handle 1, or it is smaller than this latter thickness. Thus, when also the pivotable supporting stirrup 4 is moved into its angular rest position extending in the direction of the longitudinal axis of handle 1, the razor assembly comes to have a shape resembling to a straight stick of a substantially uniform thickness, as shown in FIG. 1. In this rest condition of the razor, the shaving head 16, the shaving head-carrying fork 15 and the supporting stirrup 4 can be covered with a protective cap 26 which is slipped thereon and is snappingly fitted on the handle 1 or on its wings 6, as shown in FIGS. 1, 2 and 3. The cap 26 may be provided with a clip 27 by which the razor having been closed with the cap 26 can be clipped on the edge of a pocket, like a fountain pen.

In order to move the shaving head-carrying fork 15 together with the shaving head 16 from shaving position (FIGS. 4 to 8) into rest position (FIGS. 1 and 3), the rotatable disc 12 is to be turned by 90°, thus causing the locking tooth 22 in the positioning platelet 18 to become disengaged from the locking notch 23 in said disc 12. In the angular rest position of disc 12, the elastically loaded locking tooth 22 may be simply pressed against the peripheral surface of the extension 14 of disc 12, or it may be engaged in another locking notch (not shown). The 90° rotation of the rotatable disc 12 is limited in both directions by a stop tooth 28 which is integral with the arcuate portion of the supporting stirrup 4 and is engaged in a sector-shaped peripheral recess 29 in the extension 14 of disc 12, so that it cooperates in the fashion of a pawl with the ends of said recess 29.

The above-described embodiment of the safety razor according to the invention also affords the advantage of consisting of parts which can be made in a simple and econimical assembly. In fact, for assembling the razor it is sufficient to fit the disc 12 (together with the shaving head-carrying fork 15 and the shaving head 16) in the supporting stirrup 4, and to engage the said disc in the groove 13, by pushing it up to have the same received in the arcuate end of said stirrup 4. Then the positioning platelet 18 is likewise fitted into the supporting stirrup 4, so as to have its lateral teeth 20 snapped into the matching apertures 21 in arms 5 of stirrup 4. Thereafter, the supporting stirrup 4 is pivotably mounted between the wings 6 of handle 1, by utilizing the possibility of elastically drawing near the ends of the two arms 5 of stirrup 4, and by fitting the pivots 7 into the respective bores 8 in wings 6.

In FIGS. 9 to 12 there is shown a modified embodiment of the razor according to FIGS. 1 to 8. In this modified embodiment, the stirrup 4 supporting the shaving head 16 is fixedly mounted on to the handle 1, in a position which is substantially parallel to the axis of the handle and is eccentric with respect to said axis. In place of the stirrup 4, any other equivalent suitable support may be provided for the shaving head 16. The shaving head 16 is rotatably mounted on to the fixed stirrup 4, or on to an equivalent support, by means of any suitable rotary coupling 31 which may be, for example, made as described in connection with FIGS. 5 to 8, and the said coupling 31 permits to turn the shaving head by at least 90° around an axis which is transversal to the said head 16 and to the longitudinal axis of handle 1. Thus, the shaving head 16 can be located and preferably locked in a shaving position which is oriented transversely to the longitudinal direction of handle 1, as shown by solid lines in FIG. 9, and the said head can be caused to take a rest position which is substantially parallel to the handle 1 and is situated sideways of the support 4, as shown by dash-and-dot lines in FIG. 9. In this rest position of the shaving head 16, this head can be covered with a cap 26 shown by dash-and-dot lines in FIG. 9, which is fitted on the handle 1.

In FIGS. 9 to 12 there is shown more in detail also a preferred embodiment of the valve 2 provided at the rear or bottom end of handle 1, and which is intended for dispensing the shaving cream or lather contained within the hollow 101 in said handle 1. In these figures, numeral 102 denotes the tubular outlet nozzle of the dispensing valve 2, which is made in a manner known per se. Fixedly fitted on the nozzle 102 is a cap 30 provided with a lateral orifice 31 which through a duct 33 formed in said cap 30, is connected to the outlet of the nozzle 102. The nozzle 102 is axially slidable in the body of valve 2 and the same is outwardly urged by usual spring means (not shown) which are incorporated in the body of the dispensing valve 2, whereby it takes the closing position shown in FIG. 9, in which the outflow is intercepted of the shaving cream from the hollow handle 1. By exerting a pressure on the cap 30, the tubular nozzle 102 can be axially pushed inwards against the load of the spring means, so as to be moved into an opening position in which the shaving cream will be dispensed through the duct 33 and the lateral orifice 31 in said cap 30, from the handle 1.

Figure 11:
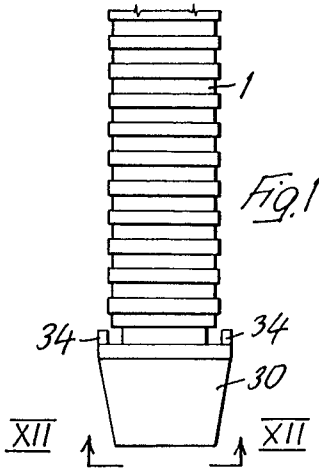
FIG. 11 is a view which is like to the view of FIG. 10, and in which the cap of the shaving cream-dispensing rear or bottom cap is rotated by 180° into unlocking position.
Figure 12:
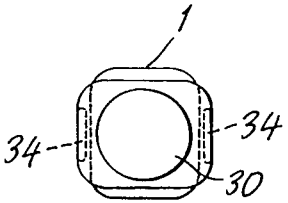
FIG. 12 is a top view of the rear or bottom end side of the razor handle according to arrows XII—XII in FIG. 11.
Figure 10:
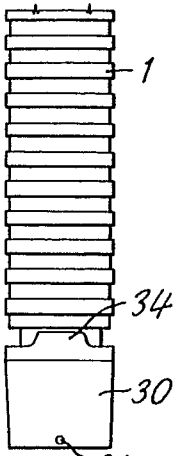
FIG. 10 is an elevational part-view of the razor handle according to arrow X in FIG. 9.
Figure 9:
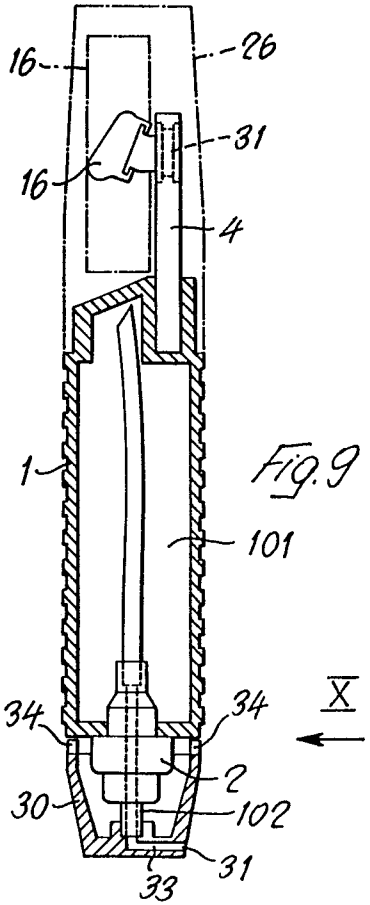
FIG. 9 is a longitudinal sectional view showing another embodiment of the safety razor according to the invention.

In order to prevent the cap 30 and then the nozzle 102 of the dispensing valve 2 from being unintentionally or accidentally pushed into their opening position for dispensing the shaving cream, at least the rear or bottom end of handle 1, and the cap 30, have a rectangular shape in cross-section, as it is particularly evident in FIG. 12. The cap 30 is rotatably mounted, relatively to the handle 1, on to the dispensing valve nozzle 102 or together with the said nozzle 102, and at the short sides of its rectangular cross-section the same presents a respective abutment projection 34 extending toward the rear or bottom end of handle 1. In an angular position of cap 30 relatively to the handle 1, in which the rectangular cross-sections of the handle 1 and the cap 30 are oriented in the same direction, so that as shown in FIGS. 9 and 10, the abutment projections 34 in cap 30 come to be in front of the rear or bottom end surface of handle 1. In this position, the projections 34 in cap 30 abut against the rear or bottom end surface of handle 1, wherevy they prevent the cap 30 from being pushed into the opening position of the dispensing valve 2. By turning the cap 30 of 90° relatively to the handle 1, the two rectangular cross-sections of the handle 1 and the cap 30 will be angularly offset in a correlative manner, and the abutment projections 34 in cap 30 will be positioned outwardly of the profile of the rear or bottom end surface of handle 1, as shown in FIGS. 11 and 12. Thus, the cap 30 can be pushed into the opening position of the dispensing valve 2, without the projections 34 abutting against the rear or bottom end surface of handle 1.

Figure 15:
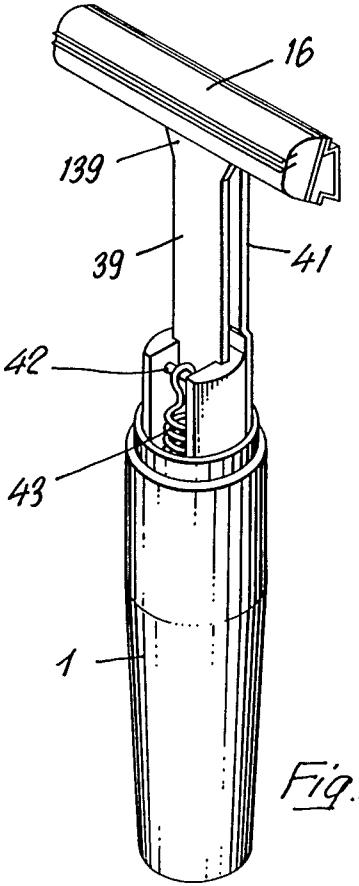
FIG. 15 is a perspective view of the razor shown in FIG. 14.
Figure 14:
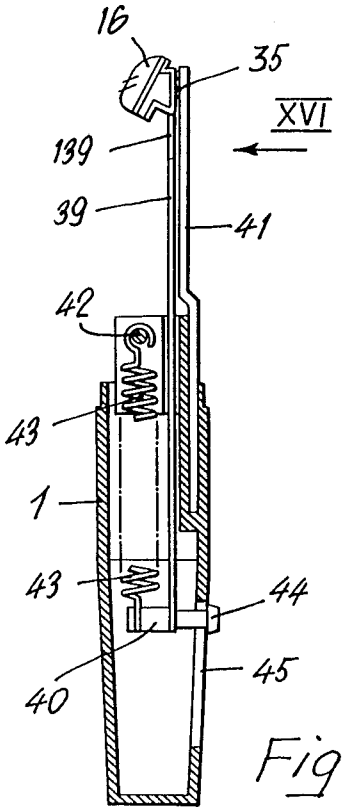
FIG. 14 is a longitudinal sectional view showing the opened razor with the shaving head in shaving position.
Figure 16:
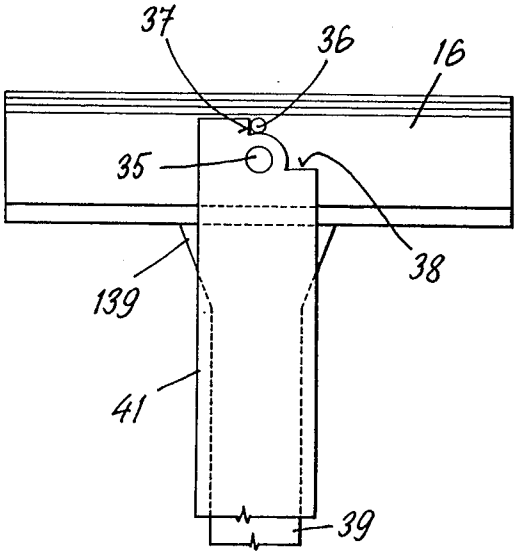

In the embodiment of the safety razor according to FIGS. 13 to 17, a shaving head-carrying rod 41 projecting from the fore or top end of handle 1, is fixed in handle 1 and extends in the longitudinal direction thereof, in an eccentric position relatively to the axis of said handle 1. The shaving head-carrying rod 41 is preferably made of metal. At the loose fore or top end of the shaving head-carrying rod 41 the shaving head 16 is pivotally connected to the pivot 35, and is rotatable around an axis which is transversal to the said head 16 and to the shaving head-carrying rod 41. Thus, the shaving head 16 can be caused to take alternatively a rest position extending in the longitudinal direction of handle 1 or of the shaving head-carrying rod 41 (FIGS. 13 and 17), and a shaving position extending transversely to the shaving head-carrying rod 41 or to the longitudinal direction of handle 1 (FIGS. 14, 15 and 16). The rotation of the shaving and rest positions, by a pawl 36 secured to the head 16 and cooperating with two stop abutments 37, 38 provided at the loose end of the shaving head-carrying rod 41, or vice-versa, as it clearly appears in FIGS. 16 and 17.

On the side of the shaving head-carrying rod 41 which is turned toward the shaving head 16, a flat shaving head-locking bar 39 is provided, which is slidably guided in the handle 1 and may be also along the shaving head-carrying rod 41, in the longitudinal direction of said rod, and which is preferably made of metal. The fore or top end 139 of the said shaving head-locking bar 39 cooperates with the shaving head 16 and ends into a transversal straight edge which preferably is orthogonal to the longitudinal direction of the shaving head-carrying rod 41, i.e. of the handle 1. Furthermore, the said end 139 of the shaving head-locking bar preferably has an enlarged configuration. The opposite, rear or bottom end of the slidable shaving head-locking bar 39 is located within a cavity in handle 1 and is provided with a pin 40 which through a pulling spring 43 is connected to a pin 42 in handle 1. This spring 43 urges the shaving head-locking bar 39 toward the shaving head 16 and causes the fore or top end 139 of the shaving head-locking bar 39 to bear against the said head 16.

The rear or bottom end of the shaving head-locking bar 39 is provided with another pin 44 which through a longitudinal slot 45 in handle 1 projects out of said handle. By manually acting on this pin 44 for the shaving head-locking bar 39, this pin can be withdrawn and disengaged from the shaving head 16, against the load of spring 43.

Under these conditions, when the shaving head 16 is located in its shaving position, the shaving head-locking bar 39 has the edge of its fore or top end 139 bearing against the longitudinal lower side of head 16, owing to the load of spring 43, so that this bar will lock the said head 16 in its shaving position, as shown particularly in FIG. 16. In order to move the shaving head 16 into its rest position, the shaving head-locking bar 39 has to be withdrawn manually with the aid of pin 44, against the action of spring 43, to such an extent that the head 16 can be freely rotated by 90° from its shaving into its rest position. Once the rest position of head 16 has been reached, the shaving head-locking bar 39 is again set free, so that it now bears with the edge of its fore or top end 139 against the corresponding front surface of the said shaving head 16, thus locking the same in rest position, as shown particularly in FIG. 17. In a similar manner, i.e., by temporaneously withdrawing with a manual operation the shaving head-locking bar 39 from the head 16, against the load of spring 43, the shaving head 16 can be unlocked while still in its rest position, and the same will be then rotated into its shaving position, and again locked in shaving position.

Figure 13:
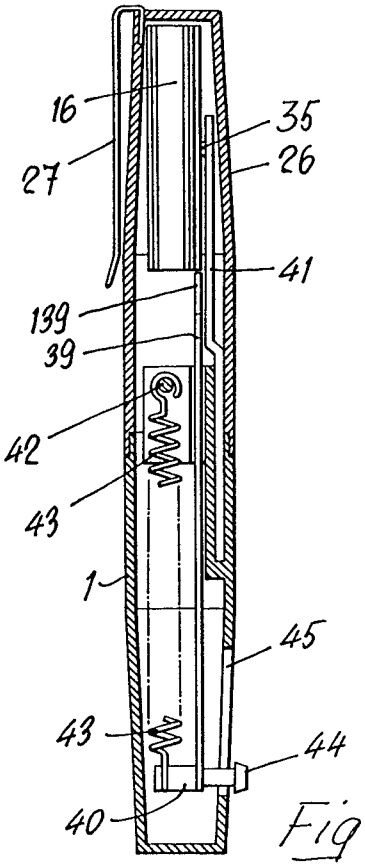
FIG. 13 is a longitudinal sectional view showing a further embodiment of the safety razor according to the invention.
Figure 17:
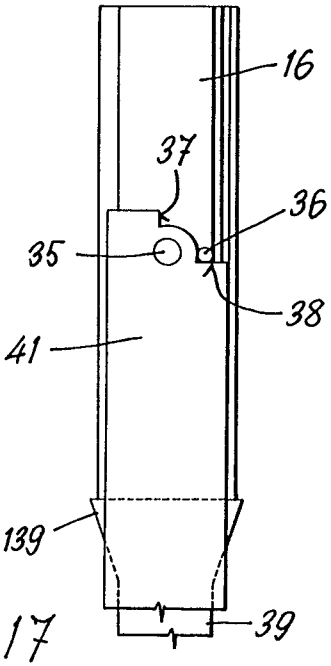
FIGS. 16 and 17 are views showing in an enlarged scale the fore or upper end of the razor according to arrow XVI in FIG. 14, with the shaving head in shaving position (FIG. 16), and in rest position (FIG. 17).

It should be noted that when the shaving head 16 is in rest position, the thickness of the assembly consisting of this head 16, of the shaving head-carrying rod 41 and the shaving head-locking bar 39, is not substantially greater than the thickness (or the diameter) of handle 1. Also the width of the shaving head-carrying rod 41, the shaving head-locking bar 39 and the enlarged fore or top end 139 of said bar is not greater than the thickness (or the diameter) of handle 1. Therefore, when the shaving head 16 is rotated into its rest position extending in the longitudinal direction of the handle 1 and the shaving head-carrying rod 41, the razor assembly come to have a shape like a straight stick of a substantially uniform thickness, as shown in FIGS. 13 and 14. In this rest condition of the razor, the shaving head 16, the shaving head-carrying rod 41, and the shaving head-locking bar 39 can be covered with a protective cap 26 which is slipped thereon and is fitted on the handle 1. The cap 26 may be provided with a clip 27 by means of which the razor having been closed with the cap 26 can be clipped on the edge of a pocket, or the like, in the fashion of a fountain pen. Generally, the safety razor according to the invention may have, when it is closed, substantially the configuration and the size of a fountain pen.

Figure 18:
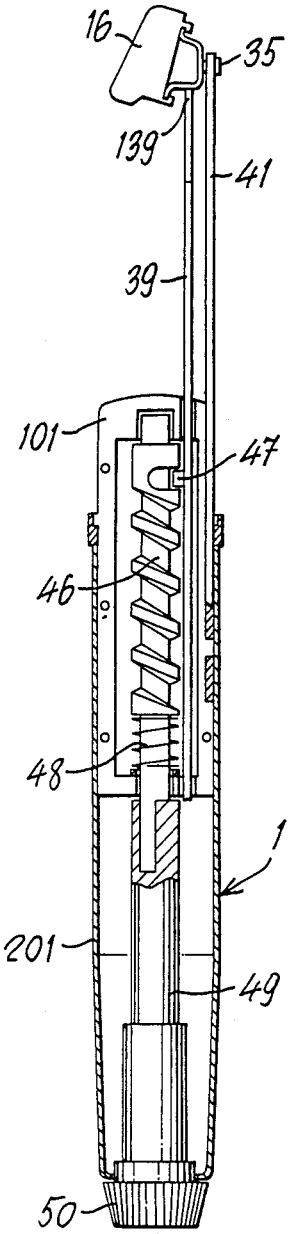
FIG. 18 is a longitudinal sectional view showing a modified embodiment of the safety razor according to FIGS. 13 to 17.

In FIG. 18 there is shown a modified embodiment of the safety razor according to FIGS. 13 to 17, like parts being designated by the same reference numerals. The object of this modified embodiment is to eliminate the pin 44 projecting from the handle 1 and the respective slot 45, through which water may leak into the hollow of handle 1. To this end, in the embodiment according to FIG. 18 the shaving head-locking bar 39 will be shifted relatively to the shaving head 16, with the aid of a worm screw 46 which is oriented in the longitudinal direction of handle 1 and is housed in the fore or upper portion 101 of said handle, so as to be allowed to rotate therewithin, but not to slide in the longitudinal direction. This fore or upper portion 101 of handle 1 is preferably made of plastics material, and is fitted in, and secured to the tubular body 201 of said handle 1, which is made of metal or of plastics material. The shaving head-carrying rod 41 has its rear or lower end portion fitted in, and secured between the fore or upper portion 101 of handle 1 and the body 201 of said handle 1. The shaving head-locking bar 39 is slidably passed through both ends of the fore or upper portion 101 of handle 1 and the same is provided with a driving side pin 47 by which it is engaged in the worm screw 46. A helical spring 48 is interposed between the worm screw 46 and the bottom of the fore or upper portion of handle 1, in order to neutralize any play. The rear or lower end of the worm screw 46 is rotatably connected with a coaxial spindle 49 ending with an external knob 50 which is provided at the rear or bottom end of handle 1. By turning the knob 50 and so the worm screw 46 in the one or the other direction, the shaving head-locking bar 39 will be shifted toward the shaving head 16 or it will be withdrawn from said head.

Of course the invention is not limited to the just described and shown embodiments, and the same may be widely changed and modified, the more so in construction. Thus, for example, instead of having a terminal straight edge, the fore or upper end 139 of the shaving head-locking bar 39 may have two aligned projections which are spaced apart transversely to the shaving head-carrying rod 41. Generally the terminal edge of the fore or upper end 139 of the shaving head-locking bar 39 may have any suitable profile adapted for cooperating with correspondingly profiled members of the shaving head 16, so that the said head will be locked in its rest and shaving positions. The shaving head-carrying rod 41 may be made of plastics material and may be made of one piece with the handle 1 as a forward or upward extension of said handle. Also the shaving head-locking bar 39 may be made of plastics material and may be guided not only along the hand grip portion of handle 1, but also along the fore or upper shaving head-carrying extension 41 of said handle.

I claim:

1. A safety razor comprising:

a shaving head having a longitudinal head axis upon which a shaving blade is mounted;

a handle including an upper handle part and a longitudinal handle axis;

a head mounting means for mounting said shaving head to said upper handle part for rotation about a head rotation axis over at least 90° between a rest position where said longitudinal head axis is parallel to said longitudinal handle axis and a use position where said longitudinal head axis is perpendicular to said longitudinal handle axis;

a shaving head locking bar having a free end;

a bar mounting means for mounting said locking bar for movement in said handle between a locked position where said free end engages said shaving head against rotation and a free position where said free end does not engage said shaving head; and a moving means for moving said locking bar between said positions.

2. A safety razor as claimed in claim 1 wherein said upper handle part has a longitudinal upper handle axis which is parallel to and offset from said longitudinal handle axis; and wherein said upper handle part together with said shaving head in the rest position are contained within a space defined by a cross section of said handle taken along a plane perpendicular to said longitudinal handle axis which is extended parallel to said longitudinal handle axis.

3. A safety razor as claimed in claim 1 and further including a cap which covers said upper handle part and said shaving head in the rest position, and a holding means for holding said cap to said handle.

4. A safety razor as claimed in claim 1 wherein said free end of said locking bar engages a portion of said shaving head which is complementary shaped.

5. A safety razor as claimed in claim 4 wherein said free end of said locking bar and said portion of said shaving head are straight surfaces.

6. A safety razor as claimed in claim 1 wherein said free end of said locking bar engages at least two points of said shaving head with said at least two points being spaced apart laterally of the longitudinal handle axis.

7. a safety razor as claimed in claim 1 wherein said free end of said locking bar is enlarged from a remainder of said locking bar.

8. A safety razor as claimed in claim 1 wherein said handle includes a cavity and a longitudinal slot;

wherein said bar moving means includes a spring which is mounted in said cavity of said handle and which urges said free end of said locking bar into engagement with said shaving head; and wherein said locking bar includes a projection at a lower end thereof which extends slidably through said longitudinal slot such that said locking bar is movable by manual movement of said projection from the locked position to the free position.

9. A safety razor as claimed in claim 1 wherein said bar moving means includes a worm screw, a means for mounting said worm screw in said handle for free rotation, a knob attached to said worm screw and extending from a bottom of said handle by which said worm screw is turned, and a projection which extends from said locking bar and engages said worm screw whereby rotation of said knob causes rotation of said worm screw and hence movement of said projection to move said locking bar between the locked and free positions.

10. A safety razor as claimed in claim 1 wherein said head mounting means includes stop abutments which limit the rotation of said shaving head to 90°.

* * * * *